US007891439B2

(12) United States Patent
Ewald

(10) Patent No.: US 7,891,439 B2
(45) Date of Patent: Feb. 22, 2011

(54) METHOD OF MULTISTAGE MANUFACTURING A GROUND BORE

(75) Inventor: Andrea Julia Ewald, Olsberg (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 160 days.

(21) Appl. No.: 12/057,893

(22) Filed: Mar. 28, 2008

(65) Prior Publication Data

US 2008/0236892 A1 Oct. 2, 2008

(30) Foreign Application Priority Data

Mar. 29, 2007 (DE) ..... 10 2007 015 088

(51) Int. Cl.
*E21D 1/06* (2006.01)
*E21B 7/28* (2006.01)

(52) U.S. Cl. ..... 175/53; 175/61; 405/184

(58) Field of Classification Search ..... 175/53, 175/62; 405/184
See application file for complete search history.

(56) References Cited

U.S. PATENT DOCUMENTS

| | | | | |
|---|---|---|---|---|
| 3,651,872 | A * | 3/1972 | Smith et al. | 173/24 |
| 6,206,109 | B1 * | 3/2001 | Monier et al. | 175/53 |
| 6,682,264 | B1 * | 1/2004 | McGillis | 405/184 |
| 7,389,831 | B2 * | 6/2008 | Mullins et al. | 175/62 |

FOREIGN PATENT DOCUMENTS

| | | |
|---|---|---|
| DE | 1 919 092 | 7/1965 |
| DE | 42 20 430 C2 | 1/1994 |

* cited by examiner

*Primary Examiner*—Giovanna C Wright
(74) *Attorney, Agent, or Firm*—Henry M. Feiereisen; Ursula B. Day

(57) ABSTRACT

In a method for multistage manufacture of a borehole between two earth shafts, a drilling device drills in a first direction a pilot bore between a starting shaft and an end shaft and lines the pilot bore with pipes. Subsequently, the pilot bore is expanded in a second direction opposite to the first direction to form an expansion bore which is simultaneously lined with pipes, while accumulating soil is transported into the end shaft in opposition to the second direction with the aid of a screw conveyor.

2 Claims, 3 Drawing Sheets

METHOD OF MULTISTAGE MANUFACTURING A GROUND BORE

CROSS-REFERENCES TO RELATED APPLICATIONS

This application claims the priority of German Patent Application, Ser. No. 10 2007 015 088.3, filed Mar. 29, 2007, pursuant to 35 U.S.C. 119(a)-(d), the content of which is incorporated herein by reference in its entirety as if fully set forth herein.

BACKGROUND OF THE INVENTION

The present invention relates to a method for multistage manufacturing a borehole between two ground pits or shafts, for example typically channel shafts.

Installation of supply or disposal pipelines oftentimes occurs between conventional channel shafts but also between specifically excavated pits. A shaft or a pit is hereby provided for receiving the drilling machine and the other shaft (pit) serves as end shaft.

Starting from a machine pit, a pilot bore is oftentimes created first between a machine pit and an end pit with the aid of a drilling device, which displaces soil to the side, when making a new pipe path, for example for waste water pipes with slight gradient. In a second drilling phase with same drilling direction, the pilot bore is upsized to the diameter of the product pipe with the aid of a drill head which is pushed by a drilling device into the end pit. At the same time, the drilling device pushes continuously single pipe sections of the product pipe or recoverable pipe from the machine pit into the earth and the pilot pipe sections into the end pit. Upsizing is normally realized by drilling, and thus requires a continuous removal of loosened soil. This is typically realized to the rear into the machine pit with the assistance of a screw conveyor which is positioned adjacent to the expansion drill head, i.e. in drilling direction downstream of the expansion drill head.

According to a known method of this type, a pilot bore of smaller diameter is first made through lateral displacement of soil from the machine pit with the aid of a drilling machine which has a drill rod comprised of several linkable sections and advancing the displacement head. As the pilot bore is expanded in a second drilling phase, the pilot bore is pressed from the machine pit with the aid of an expansion drill head, which is driven by a drilling machine in the direction of the end pit from which the individual pilot pipe sections are removed. The drill rod in the pilot bore provides hereby guidance for the expansion drill head and the screw conveyor so that the position and course of the pilot bore is maintained accurately and the expansion drill head arrives precisely in the starting pit despite its constant rotation.

Pipe sections that can be recovered normally adjoin the expansion drill head and have interiorly arranged screw conveyor sections by which earth loosened by the expansion drill head is transported to the machine pit. The screw conveyor connected to the drilling device in the machine pit serves at the same time as driveshaft for the expansion drill head. Earth continuously removed with the aid of the screw requires, however, significant space in the machine pit and thus a sufficient pit diameter in order to be able to ultimately push in the product pipe and the product pipe sections from the machine pit. In addition, drillings accumulate at the bottom of the machine pit and below the drilling device and thus can be removed only under difficulties.

Also known is a drilling and upsizing method by which earth is carried away in a second upsizing phase, not in the machine pit but rather in the end pit. This is realized with the aid of a screw conveyor which is driven by a wandering mobile motor or mobile motor moving through the pilot bore, and which is comprised of single pipe sections with interiorly arranged screw conveyor sections, placed upstream of the expansion drill head and extending into the end pit. The pipe sections accumulating in the end pit are then removed individually from the end pit. This procedure is, however, very complex because the drive for the expansion drill head is no longer arranged in the machine pit bur is implemented by a hydraulic motor which is disposed on the expansion drill head and has hydraulic lines extending through the product pipe following the drill head and required to be dragged along. Moreover, there is a need for frequent docking of extension pieces of the hydraulic line in dependence on the length of the pipe module.

A further drawback of this method resides in the fact that also in this method soil, loosened initially by the drill head in a first upsizing phase, needs to be transported in opposition to the drilling direction into the machine pit, from where it is difficult to remove. The product pipes are then pushed-in in a third drilling phase or in the second upsizing phase with the afore-mentioned direct hydraulic drive of the expansion drill head, and soil loosened during upsizing is removed with the aid of the screw conveyor in the direction of the end pit. The pipe sections with the screw conveyor sections of the second upsizing phase are then removed from the end pit and earth is removed with the aid of an excavator.

The three-step expansion drilling is not only time-consuming but requires the presence of two expansion drill heads with pipe sections having different diameters for both upsizing phases as well as a mobile hydraulic drive. In addition, loosened soil of the first upsizing phase is transported to the machine pit where it interferes with the machine operation.

It would therefore be desirable and advantageous to address these prior art problems and to obviate other prior art shortcomings.

SUMMARY OF THE INVENTION

According to one aspect of the present invention, a method of making a borehole between two pits, includes the steps of drilling a pilot bore in a first direction from a machine pit to an end pit and lining the pilot bore with a pipe casing to form a pipe string, expanding the pilot bore in a second direction in opposition to the first direction to form an expansion bore lined with a pipe casing, and transporting loosened soil into the end pit in opposition to the second direction as the pilot bore is expanded.

The present invention resolves prior art problems by making a pilot bore with a pipe casing made in a first drilling phase between the machine pit and the end pit, and then creating an expansion bore with pipe casing in a second drilling phase in opposite direction, i.e. in the direction of the machine pit, while soil is removed into the end pit in opposition to the drilling direction of the second phase.

The method according to the invention thus omits an intermediate phase for upsizing the pilot bore accompanied by all its drawbacks, while maintaining the transport direction of the soil, and realizes upsizing with the aid of a typical drilling device which has an expansion drill head that is pulled with the aid of the drill rod of the pilot bore in the direction of the starting pit, whereas loosened soil is transported in opposite direction, i.e. into the end pit, from where it can easily be removed as no aggregates are present there. Machine and end pits may hereby involve typical channel shafts.

During formation of the expansion from the end pit in the direction of the machine pit, pipe sections with an internally arranged screw conveyor section are attached in the end pit. The expansion drill head is hereby drawn with the aid of the drill rod in the pilot bore from the machine pit through the pilot bore, while the screw conveyor continuously transports earth in the opposite direction towards the end pit. On the other hand, loosened soil can also be transported hydraulically towards the end pit in the absence of the screw conveyor.

The method according to the invention allows easy removal of the pipe sections with the screw conveyor sections via the end pit, when replaced in the machine pit by product pipe sections of same outer diameter. There is, however, also the possibility to use product pipe sections which do not have to be removed.

According to one aspect of the present invention, an apparatus for making a borehole between two pits includes a drilling machine accommodated in a machine pit and having one end provided with a first drill head for forcing a plurality of successively attached first pipe sections in a first direction through earth for formation of a pilot bore lined with a pipe casing, and a second expansion drill head replacing the first drill head after formation of the pilot bore for expanding the pilot bore in a second direction opposite to the first direction to form an expansion bore lined with a pipe casing formed by second pipe sections with interiorly arranged screw conveyor sections which transport loosened soil to the end pit.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
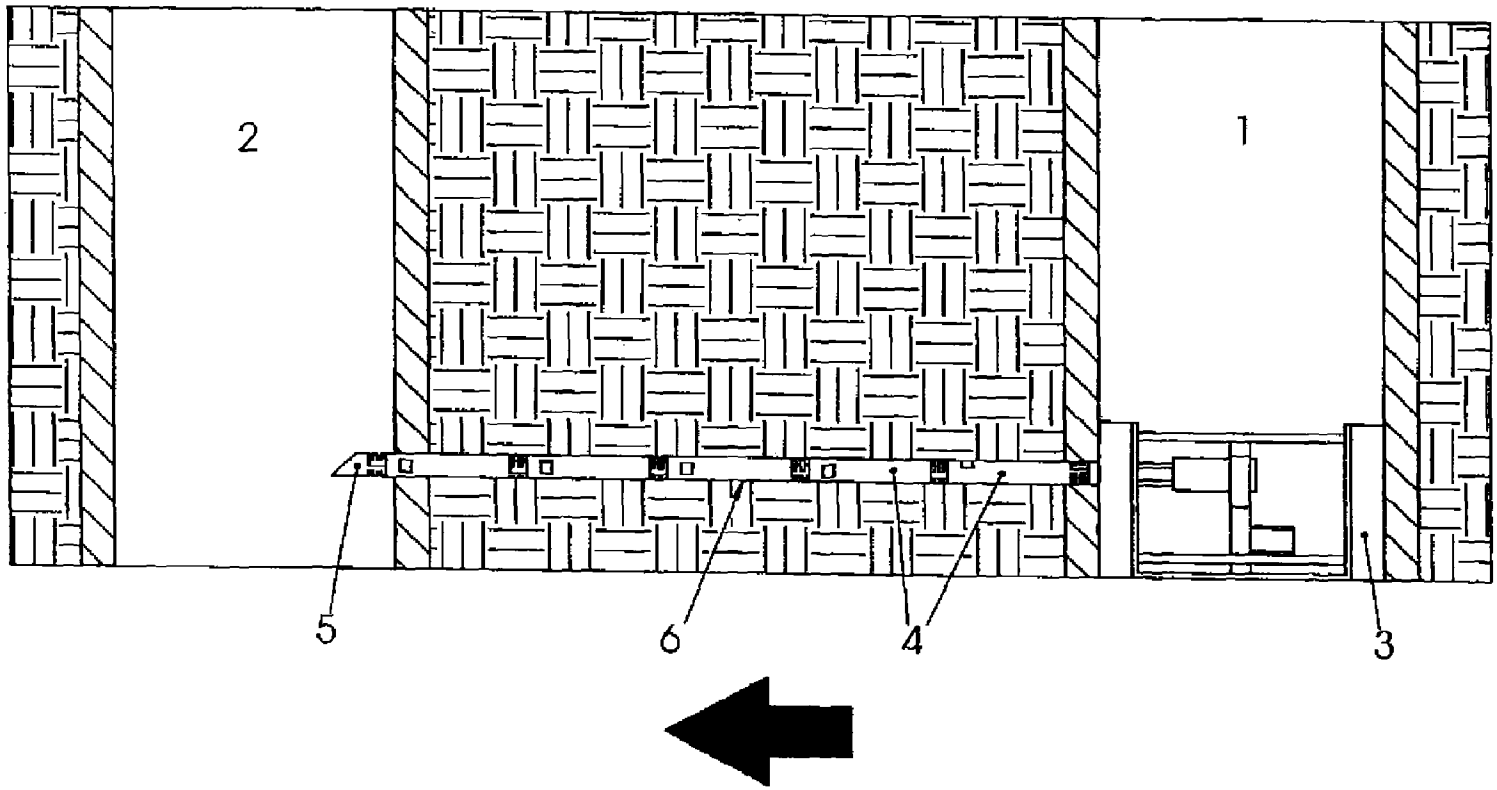
FIG. 1 is a schematic illustration of an area between a machine pit and an end pit for formation of a pilot bore between the two pits in a first drilling phase.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of an area between a machine pit 1 and an end pit 2 for installing a pipeline underground. The machine pit 1 and the end pit 2 have each a standard diameter of 1,000 mm. Accommodated in the machine pit 1 is a conventional drilling device 3 which produces a borehole by displacing soil to the side and drilling through the earth. The drilling device 3 has a drill rod comprised of single pipe sections 4 and provided with a leading drill head 5. After a pilot bore has been created and lined with a pipe casing 6 of single pipe sections 4 by the drilling device 6, the drill head 5 is removed and replaced by. The expansion drill head 7 is accommodated in a pipe section 8 which is attached to the leading one of the pie sections 4. The pipe section 8 is adjoined by single pipe sections 9, 10 which accommodate screw conveyor sections 11, 12, respectively, and are introduced via the end pit 2. The string of pipe sections 4 of the pipe casing 6 and the screw conveyor sections 11, 12 in the pipe sections 9, 10 are caused to rotate and pulled by the drilling device 3 in the direction of the machine pit 1, while the pipe sections 9, 10 do not rotate. This is implemented by placing between the expansion drill head 7 and the pipe section 8 a swivel which transmits only pulling forces.

As soon as the expansion drill head 7 arrives with the pipe section 8 in the machine pit 1 and the pipe sections 4 have all been removed from the machine pit 1, pipe sections 13, 14 of same outer diameter as the pipe sections 8, 9, 10 are attached to the pipe section 8 with the expansion drill head 7, and the pipe section 8 and the pipe sections 9, 10 with internal screw conveyor sections 11, 12 are pushed out of the earth into the end pit 2. As they clear the earth, the thus liberated pipe sections 9, 10 can be removed from the end pit 2, as indicated with respect to the pipe section 10, depicted in broken line. The pipe sections 13, 14 form ultimately together with further such pipe sections the finished pipe 15.

Figure 2:
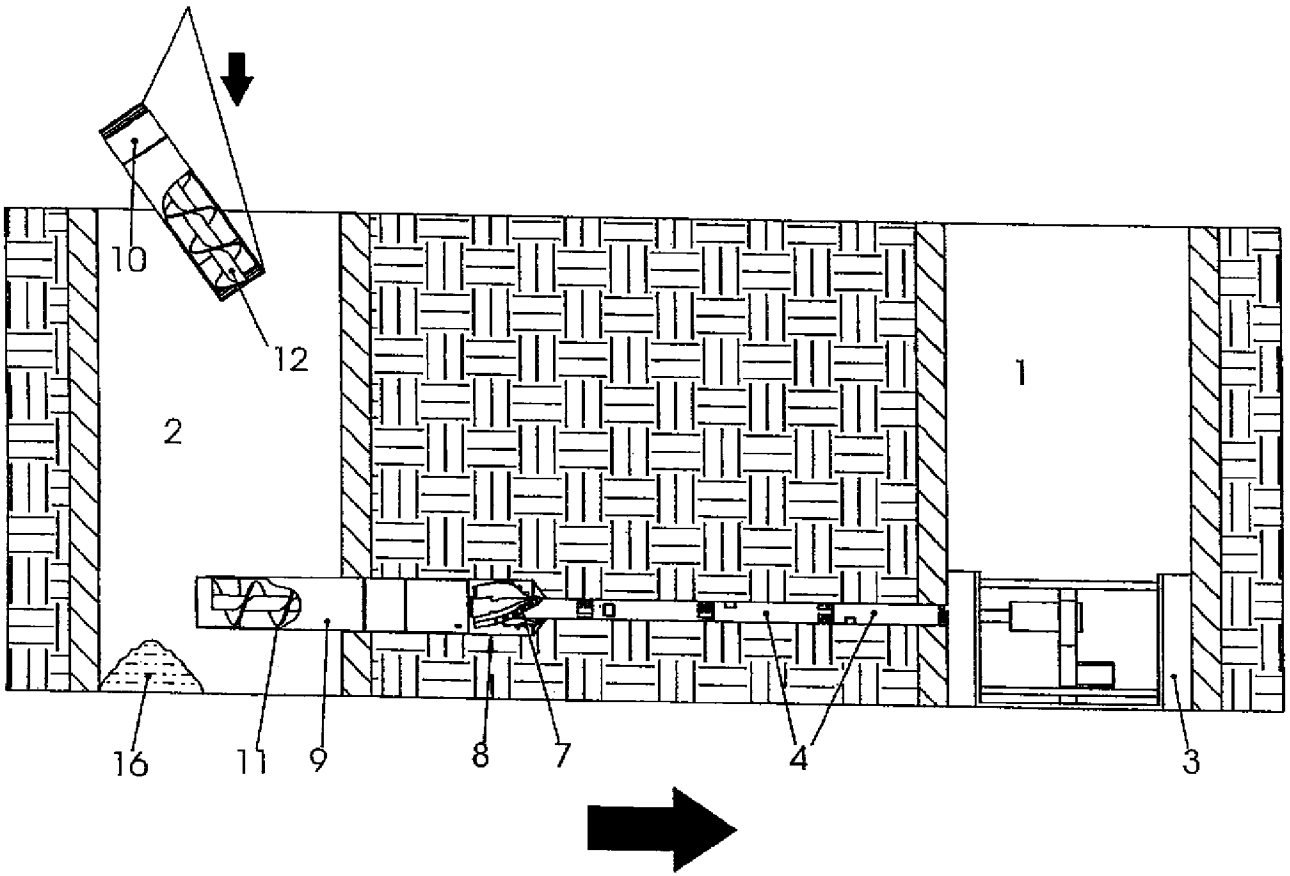
FIG. 2 is a schematic illustration of a second drilling phase involving the upsizing of the pilot bore starting from the end pit while simultaneously transporting loosened soil in the opposite direction.
Figure 3:
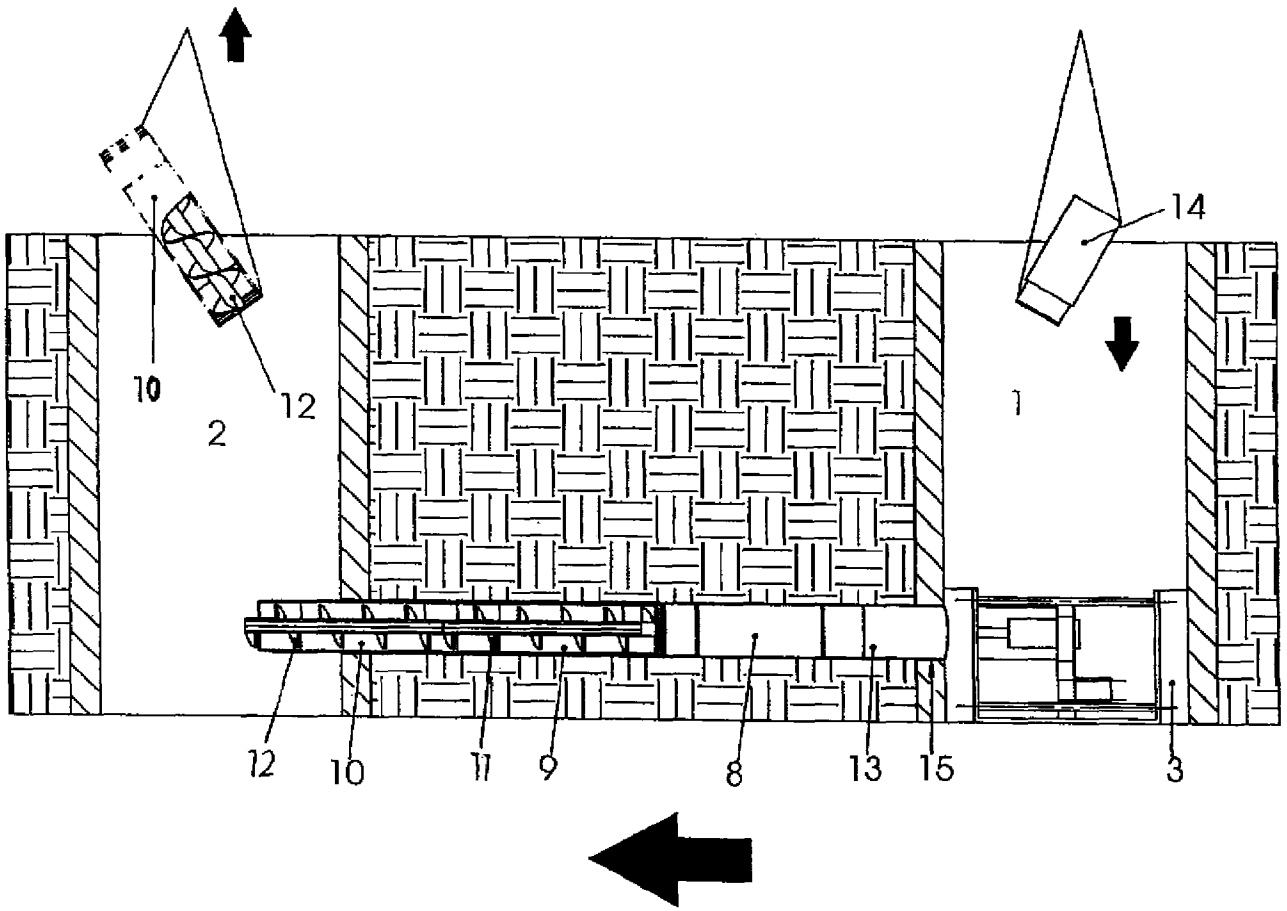
FIG. 3 is a schematic view, illustrating the installation of product pipes via the machine pit and the removal of screw conveyor sections via the end pit.

Loose soil 16 can be removed from the end pit 2 by an unillustrated excavator, without any interference from machine parts and without requiring further bore upsizing between the formation of the pilot bore (FIG. 1) and the formation of the expansion bore (FIG. 2). The expansion of the pilot bore, as shown in FIG. 2, is followed only by the attachment of the product pipe sections 13, 14 as replacement for the screw pipe sections 8, 9, 10. There is no risk of divergence or a directional deviation of the finished borehole because the pipe section 8, 9, 10 do not rotate in the earth.

The method according to the invention allows in the second method step also the use of product pipes with internally arranged screw conveyor sections, for example, which are interconnected in a tension-proof manner and which ultimately require removal of only the screw conveyor sections in the starting pit or end pit. Or loose product pipes may be interconnected or braced with one another via the screw at the end of the pipe string. Irrespective thereof, loosened soil is always removed in accordance with the method of the invention via the machine-free pit or machine-free shaft.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method of making a borehole between two pits, comprising the steps of:

drilling a pilot bore in a first direction from a machine pit to an end pit and lining the pilot bore with a pipe casing to form a pipe string;

expanding the pilot bore in a second direction in opposition to the first direction to form an expansion bore lined with a pipe casing by attaching first pipe sections with interiorly arranged screw conveyor sections in the end pit in succession onto the pipe string of the pilot bore to form the pipe casing of the expansion bore; thereby transporting loosened soil into the end pit in opposition to the second direction as the pilot bore is expanded;

successively attaching in the machine pit finished second pipe sections of a same diameter as the first pipe sections with interiorly arranged screw conveyor sections onto the first pipe sections; and removing the first pipe sections from the end pit.

2. The method of claim 1, wherein the transporting step includes the step of injecting a fluid through the pipe string for moving the loosened soil during the expanding step in the direction of the end pit.

* * * * *